United States Patent [19]

Browne

[11] Patent Number: 4,462,177

[45] Date of Patent: Jul. 31, 1984

[54] A.C. CONNECTION CIRCUIT FOR DISPLAY OR INDICATOR

[75] Inventor: John P. Browne, Georgetown, Canada

[73] Assignee: Nei Canada Limited, Toronto, Canada

[21] Appl. No.: 446,946

[22] Filed: Dec. 6, 1982

[51] Int. Cl.[3] ..... G09F 21/04

[52] U.S. Cl. ..... 40/463; 340/815.24; 340/764; 40/449

[58] Field of Search ..... 40/449, 463, 447; 340/373, 764

[56] References Cited

U.S. PATENT DOCUMENTS

| | | | |
|---|---|---|---|
| 3,745,563 | 7/1973 | Jones et al. | 40/447 |
| 3,949,392 | 4/1976 | Caritato | 340/336 |
| 3,975,728 | 8/1976 | Winrow | 40/447 |
| 4,006,476 | 2/1977 | Romney | 340/373 |
| 4,064,503 | 12/1977 | Saylor et al. | 340/325 |
| 4,264,906 | 4/1981 | Wakatake | 340/764 |
| 4,394,652 | 7/1983 | Rabette | 340/764 |

*Primary Examiner*—Gene Mancene
*Assistant Examiner*—Wenceslao J. Contrera

[57] ABSTRACT

An electromagnetic display element is controlled by one or more high remanence cores which have control windings. A circuit is connectable to an A.C. outlet and provides to the windings a D.C. pulse in one sense (to switch the display element in one direction) when the circuit is connected to the A.C. outlet. The circuit included a capacitor charged during such connection. The circuit is designed so that, on its disconnection from the A.C. outlet, the capacitor discharges through the winding in the opposite sense and switches the display element in the opposite direction.

12 Claims, 3 Drawing Figures

A.C. CONNECTION CIRCUIT FOR DISPLAY OR INDICATOR

Figure 1:
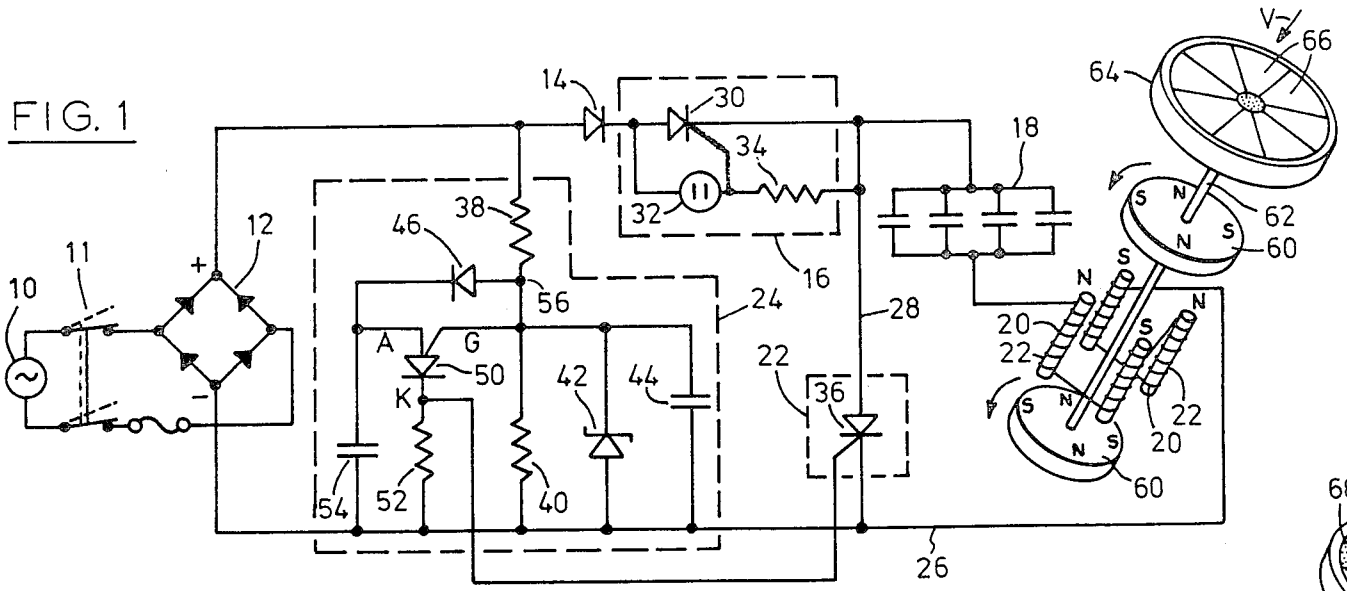

This invention relates to electromagnetic display or indicator elements and to circuitry for connecting them to an A.C. source.

Electromagnetic indicator or display elements are direct current actuated. Many, and this includes those with which the invention is concerned, are controlled by the polarity of a high remanence magnetic core which is switched in magnetic polarity and the element altered in appearance by a short duration D.C. pulse. After such pulse the core retains its polarity and the display element its changed appearance until the high remanence core is again switched in its magnetic polarity by a further pulse.

Such D.C. pulsed, and high remanence magnetic cores have been used in several different types of display or indicator elements exemplified by:

(a) the rotating vane type shown in co-pending application No. 390,311 filed June 21, 1982, by the assignee of this application.

(b) types using rotating disc or bar elements exemplified by our U.S. Pat. No. 4,223,464 dated Sept. 23rd, 1980 and by U.S. Pat. No. 3,996,680 dated Dec. 14, 1976 and U.S. Pat. No. 3,975,728 dated Aug. 17, 1976 which issued to Ferranti-Packard Limited.

(c) lever types exemplified by U.S. Pat. No. 3,537,197 dated Nov. 3, 1970 which issued to Ferranti-Packard Limited.

(d) solid element types as shown in U.S. Pat. No. 3,469,258 dated Sept. 23, 1969 issued to Ferranti-Packard Limited.

Display and indicator elements exemplified in the patents and applications referred to above have required relatively complex convertors for converting available AC power to supply the D.C. pulses required and have required extensive logic to control the pulsing of such elements in arrays.

Although such D.C. controls are useful and successful there is also a requirement for circuitry which will allow easy connection of display or indicator elements of the above types to available A.C. supplies. This invention provides such a circuit. Because of the circuit in accord with the invention the electromagnetic display element will then operate in accord with the on-off controls formerly provided for an incandescent light sign or other A.C. supply.

In general it may be said that the circuit in accord with the invention allows a high remanence electromagnetic display or indicator element to be attached to an available A.C. power supply with the element being switched in appearance by the switching on and off of the A.C. supply.

The invention provides in combination electromagnetic display or indicating element controlled by a switchable high remanence magnetic core and having a coil for magnetizing said core which is pulsed to switch the magnetization of the core in combination with a circuit. The circuit as arranged in response to connection to an A.C. line to produce a pulse for the coil to polarize the core in one sense. A capacitor or capacitors are provided which, during the connection of the A.C. power, are charged to a sufficient degree to, (when later required) polarize the core in the other sense. The capacitor is connected in an sub-circuit controlled by a switch means, designed, when the switch means is closed, to discharge through said coil to polarize the core in the other sense. The circuit is designed so that the switch means maintains the discharge sub-circuit open when the A.C. supply is connected thereto, but so that the switch means is closed, to discharge the capacitors (and reverse the polarity of the core) when the over all circuit is disconnected from the mains.

In result there is provided a circuit whereby an electromagnetic sign may be arranged for connection to an A.C. supply wherein, on such connection, the circuit causes magnetization of the core in one sense to cause the element to display one appearance; while the disconnection of the circuit magnetizes the core in the opposite sense to cause the element to display the opposite appearance. The circuit provides that substantive power is required from the A.C. mains only in a short interval just after connection of the A.C. and thereafter (since the magnetic core has high remanence) no power is required to maintain the appearance of the display element and only a small amount of power is required to maintain the charges in the capacitors (those mentioned above and others) required to produce the discharge current when the alternating current is disconnected from the circuit. Again due to the high remanence of the core no power is required to maintain the opposite appearance of the display element after the core polarity has been reversed by the discharge current.

Figure 1A:
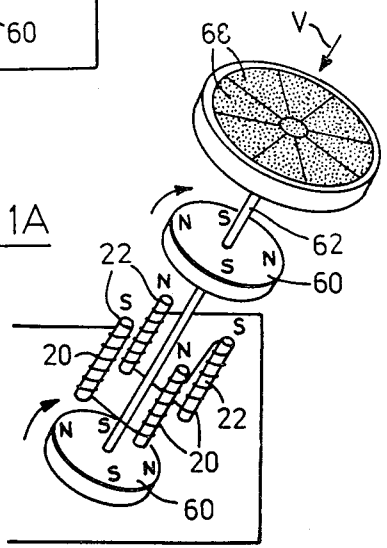
Figure 2:
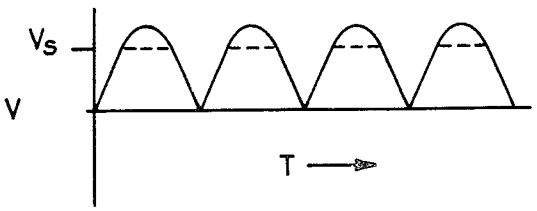

In drawings which illustrate a preferred embodiment of the invention:

FIG. 1 shows a display element in combination circuit in accord with the invention for connection between an A.C. supply and a magnetic core, FIG. 1A shows the display element of FIG. 1 in its position to give a contrasting appearance to the appearance of FIG. 1, and FIG. 2 shows a wave form of the D.C. current used by the circuit of FIG. 1.

In the drawings, an A.C. supply is connectable by a switch 11 across a full wave rectifier 12. A fuse 13 is usually provided in the circuit. The positive output of the rectifier 12 is connected through diode rectifier 14 to switching circuit 16 and diode rectifier 14 is poled to conduct in the direction of switching circuit 16. The output of switching circuit 16 is connected to a bank of one or more parallel capacitors 18 which bank is in series with the series arranged coils 20 which energize the cores 22 of the display element. The cores 22 associated with coils 22 are the high remanence cores of the display or indicating element involved. The series arranged coils 20 remote from the capacitor bank are connected by line 26 to the negative terminal of full wave rectifier 12. Connected in parallel with the capacitor bank and coils between switching circuit 16 and negative line 26 is line 28 including switching circuit 22. Connected between the positive and negative output terminals of full wave rectifiers is switching control circuit 24. Switching control circuit 24 is designed to detect the termination of potential across the full wave rectifier terminals and responsive thereto to close switch 22 completing the connection along line 28. Switch 22 is designed to be open except for an interval after switch 24 detects the fall of full wave rectifier output such interval continuing as long as voltage above a lower limit exists in the capacitor bank.

Shown schematically in FIGS. 1 and 1A is the rotating vane type display or indicating element disclosed in co-pending application No. 390,311 filed June 21, 1982 by the assignee of this application. Such display element which is only schematically indicated here has a stator comprising the four coils 22 and cores 20 arranged equiangularly about the axis of rotor shaft 62. The stator also includes stator vanes 66 of one contrasting colour mounted on stator vane ring 64. The stator vanes 66 follow a helical locus and are spaced to allow the passage therebetween of similarly shaped and spaced rotor vanes. The rotor vanes 68 (which are of contrasting colour to the stator vanes) are mounted for rotation by shaft 62 which bears a pair of four poled magnets 60. The four poled magnets 60 rotate with rotor shaft 62 and are located with their poles opposite the respective ends of cores 22. The magnet 60 (with stop means not shown) is oriented and arranged to be attracted to one rotary limiting position by the polarity of the cores 20 and this is the position of FIG. 1 with the dark stator vanes 66 obscured in the viewing direction V by the light rotor vanes, which rotor vanes 68 show a circle of light appearance in the viewing direction V. When the magnetization of cores 22 is reversed by coils 20 to the polarity indicated in FIG. 1A, the forces on magnets 60 cause rotation of the magnets 60, shaft 62 and rotor vanes 68. During such rotation helical cam means not shown and an axial sliding coupling (not shown) between rotor blades 68 and shaft 62 allow the rotor blades 68 to move between stator blades 66 to a rotary limiting position indicated in FIG. 1A where dark stator blades 66 obscure the light rotor blades 68 and show a circle of dark appearance in the viewing direction V. When the polarity of the cores is again reversed to that of FIG. 1, the rotor blades again pass through the stator blades, in reverse of their previous motion, to obscure the stator blades and again show a bright appearance in the viewing direction. Since FIG. 1 shows the 'set' or active position of the display (with the inventive circuit connected) it will be realized that FIG. 1A shows the quiescent position of the display with the circuit disconnected.

Although some detail of the preferred circuitry has not been described, it is believed that it would be helpful to a broad understanding of the invention to describe the operation of the circuitry as described in general terms, so far. With switch 11 open, no power will be connected to the line, switches 16 and 22 will be open and no charge will exist on capacitor bank 18. For reasons to be hereafter explained, the cores 22 will be in the polarities shown (and labelled S-N-S-N clockwise from the left) in FIG. 1A which hold the rotor of the display indicator in a position where the white rotor vanes 68 are obscured in the viewing direction by the black stator vanes 66.

When the circuit is connected to the A.C. supply (as schematically indicated by the closure of switch 11) power from the full wave rectifier 12 closes switch 16 at a time when the ripple current from full wave rectifier 12 (indicated in FIG. 2) is sufficient both to charge capacitor bank 18 to its desired voltage and, in the course of such charging, through the associated current pulse to "set" the cores, that is to switch the polarities from those indicated in FIG. 1A to those indicated in FIG. 1. The display element, in accord with the operation fully described in application No. 390,311, and briefly described here will switch from a black to a white appearance since rotation of the display element rotor will move the white rotor vanes 68 in front of the black stator vanes 66 to obscure the latter. With the capacitor bank 18 charged, the cores 22 "set" as shown in FIG. 1, the current drawn by the circuit will be very small, merely sufficient to replace leakage in capacitor bank 18 and to replace leakage of capacitors or other losses in switch 24. No current is required to maintain the polarization of cores 22 (or to maintain the appearance of the element) because of the high remanent magnetism in cores 22.

When it is desired to switch the display element to its black appearance the circuit is disconnected from the A.C. outlet as schematically indicated by the opening of switch 11. There is no voltage output from full wave rectifier 12. The drop of rectifier 12 output to zero voltage is detected by switching control circuit 24. Control circuit 24 is designed to close switch 22 responsive to such detection. This allows the discharge of capacitor bank 18 through switch 22 and coils 20. The resultant current through coils 20 (which is in the opposite sense to that when the circuit was connected to the A.C. mains) resets cores 22, that is it reverses their polarity to that shown in FIG. 1A, switching the appearance of the display element from white to black. The capacity of capacitor bank 18 must be selected, having regard to the voltage from full wave rectifier 12 and the other circuit parameters, to reverse the magnetism of cores 22 on such capacitor discharge. It will be seen therefore that the circuit provides coupling for the electromagnetic display element to an A.C. outlet which will switch the element to provide one appearance with the A.C. power is connected and to the opposite appearance when the A.C. power is disconnected. (It will be noted that this provides automatic "blanking" of a sign made of such display elements in the event of power failure). Moreover, the power demand is minimal since during the period that the A.C. power is connected, no power is required to maintain the magnetism of the cores. It should also be noted that, although the display element shown is of the vane operated type, the display element may be of any of the electromagnetic types controlled by a high remanence magnetic core (equivalent of the core 22) hence the display element may be of the disc, bar, lever or solid types illustrated in the patents referred to in paragraph three of this application.

Further while 4 capacitors 18 are shown their place (with this or displays of the other types referred to) may be taken by a single large capacitor or by a different number. The capacity required will depend on the coils and cores employed and their circuit parameters. Moreover with some display devices only one core 22 and coil 20 will be required, or two or more instead of the four shown as will be obvious from reference to the patents previously referred to.

Although a device connected by the inventive circuit may be used singly as an indicator, arrays of such devices will frequently be used to portray indicia or designs, as shown in the patents and the application previously referred to.

In accord with the preferred embodiment of the invention the preferred form of the elements is as now described.

Switching circuit 16 is used to ensure that when the D.C. ripple current is first applied to capacitors 18 and cores 22 the voltage is sufficient not only to charge the capacitors but also to reverse the magnetization of cores 22. FIG. 2 is a voltage-time graph of the ripple current from full wave rectifier 12. A voltage Vs dependent on circuit characteristics (principally of capacitor bank 18 and coils 20 and cores 22) is required to reverse core magnetization. (If the voltage Vs is present it is found that it does not matter to the magnetization of core 22 whether the ripple voltage is rising or falling at the time of connection of switch 16). Switch 16 is designed to prevent connection of the positive full wave rectifier 12 output to capacitors 18 unless or until the ripple voltage is at or above level Vs. Switch 16 comprises an SCR 30 whose anodecathode circuit is connected between the output terminal of diode rectifier 14 and capacitor bank 18. High voltage neon lamp 32 is connected between the anode and gate of SCR 30 and a resistance 34 is connected between the SCR gate and cathode. When the A.C. power is initially connected then the SCR 30 is not turned on until Vs is reached. When Vs at the full wave rectifier terminals is reached or if it exists when the AC is connected lamp 32 is designed to switch to its conducting and low impedance mode raising the potential at the gate of SCR 30 sufficiently to turn on the SCR. The function of neon lamp 32 could be duplicated by a conventional R-C phase shift network and trigger diode. It will be appreciated that, in pace of the specific circuitry shown, the switch 16 may be any device for providing the connection when the voltage Vs is existing at the full wave rectifier.

The capacity of the capacitor bank is selected to provide the necessary capacity to energize coils 20 to reverse the magnetism of cores 22.

Switch 22 is, with the particular switch control shown, embodied by an SCR 36 whose anode is connected to the output of switch 16 and whose cathode is connected to line 26. The gate of SCR 36 is connected to control circuit 24 as now described.

Control circuit 24 comprises the resistors 38 and 40 connected in series across the output of full wave rectifier 12. A zener diode 42 and capacitor 44 are connected in parallel with resistance 40 to line 26. The zener diode 42 is poled to conduct from line 26 toward node 56 and to breakdown in the direction node 56 to line 26 at a predetermined voltage (which is 20 V with the parameters described hereafter). Node 56 is connected through diode 46 then capacitor 54 in series to line 26 with diode 46 poled to conduct toward line 26. The anode of a programmable uni-junction transistor 50 is connected between diode 46 and capacitor 54. Node 56 is connected to the gate of transistor 50. The cathode of transistor 50 is connected through resistor 52 to line 26. The cathode of transistor 50 is also connected to the gate of SCR 36 in switch 22.

The programmable uni-junction transistor 50 is selected to have substantially no linear region, that is to have a very rapid transition from non-conducting to conduction states.

The operation of the preferred switch control 24 and switch circuit 22 is as follows:

After switch 11 is closed that portion of the ripple voltage appearing across resistor 40 is smoothed by the combined effects of resistor 40 and capacitor 44 and that part of the voltage larger than the selected 20 volts is discharged across zener diode 42. The result is a relatively constant 20 volts at node 56 applied to the gate of transistor 50 and the same voltage is applied to the anode over diode 46. Transistor 50 is off and its cathode is then at the same potential level as line 26 and maintains SCR 36 switched off.

When the A.C. is disconnected by openings switch 11, capacitor 44 begins to discharge through resistor 40 so that node 56 and the gate of transistor 50 falls in voltage faster than any drop at the transistor anode due to leakage from condenser 54. At the "turn-on" anode-gate differential transistor 50 conducts over resistor 52 raising the cathode voltage to a point where SCR 36 turns on. The capacitor bank 18 then discharges through coils 20 reversing the magnetism in cores 22 and resetting the display device, so that the cores are magnetized and the display device is dark as shown in FIG. 1A. SCR 30 ceased to conduct when the current therealong dropped below its minimum to sustain conduction and SCR 36 ceases to conduct when the current therethrough drops below the minimum required to sustain conduction.

The display device, in accord with the operation just described and earlier described, will then maintain the appearance of FIG. 1A, without power, due to the high remanence of cores 22 until it is again switched by the reconnection of the A.C. line.

Without limiting the scope of the application as defined by the claims or the discussion of the alternatives as previously discussed, values for the preferred circuit of FIG. 1 are shown below and are exemplary only. Such values are for an AC supply for 110 volts and coils 20 which to reverse the magnetism of cores 22 require a 3 amp. pulse of 500μ sec duration.

| | | | | |
|---|---|---|---|---|
| R | 34 | 1K | Ω | ¼ W |
| R | 38 | 120K | Ω | ¼ W |
| R | 40 | 1 MEG | Ω | ¼ W |
| R | 52 | 1 K | Ω | ¼ W |
| C | 54 | .047 | μf | 250 V |
| C | 44 | .047 | μf | 250 V |
| C | 18 (bank) | 8.8 | μf | 250 V |

SCR 30 Model S 2800 Manufactured by RCA Corporation, New York, N.Y.

SCR 36 Model S 2800 Manufactured by RCA Corporation, New York, N.Y.

Transistor 50 Model 2N6027 Manufactured by General Electric.

| | |
|---|---|
| Neon 32 breakdown voltage | 120 V |
| Zener diode 42 breakdown voltage | 20 volts |

I claim:

1. In combination with a display element designed to move under the control of a reversible magnetic field between two limiting positions which provide mutually contrasting appearances in a viewing direction corresponding to said positions, the position of said display element being controlled by at least one stationery core of reversible permanently magnetizable material the two limiting positions of said display element corresponding to the opposite magnetizations for said core, and a coil corresponding to said at least one core for controlling the magnetization thereof, a circuit comprising:

means for connection of the circuit to an AC supply, means for rectifying the current received from said supply, means in said circuit responsive to the connection of said current to said A.C. supply for causing said rectified circuit to magnetize said core in one sense, at least one capacitor, means in said circuit responsive to the connection of said circuit to said A.C. supply for causing said rectified current to maintain a charge on said capacitor during said connection, said charged capacitor having the capacity on discharge through said coil to reverse the magnetization of said core, a discharge path for the charge on said capacitors through said coil, switching means for interrupting and connecting said discharge path, means in said circuit responsive to the connection of said circuit to said AC supply to maintain said discharge path interrupted, means in said circuit responsive to the disconnection of said circuit from said A.C. supply for causing connection of said discharge path.

2. Circuit for controlling electromagnetically actuated display element, said element including at least one reversible permanently magnetizable core whose sense of magnetization is controlled by a corresponding energizing coil and which sense of magnetization determines which of two contrasting appearances is displayed by said display element, said circuit comprising:

means responsive to connection of said circuit to an A.C. line for energizing said coil to magnetize said core in one sense, at least one capacitance, means, responsive to connection of said circuit to an A.C. line for charging said capacitance, an interruptable circuit for allowing said capacitor to discharge through said coil in a sense to magnetize said core in the opposite sense, switching means for completing or interrupting said interruptable circuit, said switching means being designed to maintain said interruptable circuit open during connection of said circuit to said A.C. line, means responsive to the disconnection of said circuit from said A.C. device to activate said switching means to close said interruptable circuit.

3. In combination an electromagnetically operated display or indicating element and a circuit for connecting said circuit to an A.C. line, said element being designed and constructed, responsive to a current pulse in one sense, to have one appearance in a viewing direction and responsive to a current pulse in the opposite sense to have a contrasting appearance in such viewing direction, said circuit comprising:

a rectifier for rectifying said alternating current from said A.C. line, at least one capacitor connected to be maintained charged by the output of said rectifier during the connection of said circuit through said A.C. line, a discharge path for said capacitor, means for completing said discharge path for the interval required to substantially discharge said capacitor responsive to the disconnection of said circuit from said A.C. line, means interrupting said discharge path outside of said interval, means, responsive to connection of said A.C. circuit to said A.C. line for providing such current pulse in one sense, said capacitor and said discharge path being designed during said interval to provide such current pulse in the other sense.

4. In combination as claimed in claim 1 wherein said at least one capacitor is connected in series with said at least one coil across said rectifying means and in said discharge path whereby charging said capacitor magnetizes said core in one sense and discharge of said capacitor in said discharge path magnetizes said core in the other sense.

5. Circuit as claimed in claim 2 wherein said at least one capacitor is connected in series with said at least one coil across said rectifying means and in said discharge path, whereby charging said capacitor magnetizes said core in one sense and discharge of said capacitor in said discharge magnetizes said core in the other sense.

6. In combination as claimed in claim 3 wherein said circuit is so designed that said current pulse in one sense is provided by the current charging said capacitor and said current pulse in the other sense is provided by the current discharging said capacitor.

7. In combination as claimed in claim 1 wherein said element comprises stator vanes and rotor vanes of contrasting colours with said rotor vanes designed to rotate and move between said stator vanes and is so designed that in one limiting position said stator vanes obscure said rotor vanes in the viewing direction and, in the other limiting position, said rotor vanes obscure said stator vanes on the viewing direction.

8. In combination as claimed in claim 2 wherein said element comprises stator vanes and rotor vanes of contrasting colours with said rotor vanes designed to rotate and move between said stator vanes under control of said core and is designed that in one sense of magnetization of said core said stator vanes obscure said rotor vanes in the viewing direction and, in the other sense of magnetization of said core said rotor vanes obscure said stator vanes in the viewing direction.

9. In combination as claimed in claim 3 wherein said element comprises stator vanes and rotor vanes of contrasting colours with said rotor vanes designed to rotate and move between said stator vanes actuated by said current pulses and is so designed that responsive to a current pulse in one direction said stator vanes obscure said rotor vanes in the viewing direction and, responsive to a current pulse in the other direction said rotor vanes obscure said stator vanes in the viewing direction.

10. In combination as claimed in claim 7 wherein said at least one capacitor is connected in series with said at least one coil across said rectifying means and in said discharge path whereby charging said capacitor magnetizes said core in one sense and discharge of said capacitor in said discharge path magnetizes said core in the other sense.

11. Circuit as claimed in claim 8 wherein said at least one capacitor is connected in series with said at least one coil across said rectifying means and in said discharge path, whereby charging said capacitor magnetizes said core in one sense and discharge of said capacitor in said discharge magnetizes said core in the other sense.

12. In combination as claimed in claim 9 wherein said circuit is so designed that said current pulse in one sense is provided by the current charging said capacitor and said current pulse in the other sense is provided by the current discharging said capacitor.

* * * * *